US005544729A

United States Patent [19]

Brunn

[11] Patent Number: 5,544,729

[45] Date of Patent: Aug. 13, 1996

[54] CURVED ESCALATOR

[75] Inventor: Erik Brunn, Delmenhorst, Germany

[73] Assignee: O&K Rolltreppen GmbH, Hattingen, Germany

[21] Appl. No.: 284,520

[22] PCT Filed: Sep. 18, 1993

[86] PCT No.: PCT/EP93/02530

§ 371 Date: Jan. 13, 1995

§ 102(e) Date: Jan. 13, 1995

[87] PCT Pub. No.: WO94/07787

PCT Pub. Date: Apr. 14, 1994

[30] Foreign Application Priority Data

Sep. 25, 1992 [DE] Germany ..... 42 32 113.1

[51] Int. Cl.[6] ..... B66B 21/06

[52] U.S. Cl. ..... 198/328; 198/333

[58] Field of Search ..... 198/328, 332, 198/333

[56] References Cited

U.S. PATENT DOCUMENTS

| | | | |
|---|---|---|---|
| 2,570,135 | 10/1951 | Loughridge | 198/332 |
| 4,949,832 | 8/1990 | Sansevero | 198/328 |
| 5,050,721 | 9/1991 | Sansevero et al. | 198/328 |
| 5,170,875 | 12/1992 | Kubota | 198/332 X |

FOREIGN PATENT DOCUMENTS

| | | | |
|---|---|---|---|
| 0142363 | 5/1985 | European Pat. Off. . | |
| 0390630 | 10/1990 | European Pat. Off. . | |
| 3437369 | 4/1985 | Germany . | |
| 3839974 | 5/1990 | Germany . | |
| 4036667 | 4/1992 | Germany . | |
| 1678744 | 9/1991 | U.S.S.R. | 198/333 X |
| 2174967 | 11/1986 | United Kingdom | 198/333 X |

*Primary Examiner*—Joseph E. Valenza
*Assistant Examiner*—Dean A. Reichard
*Attorney, Agent, or Firm*—Spencer & Frank

[57] ABSTRACT

A curved escalator in which the occurrence of an unacceptably wide gap between the steps or between the steps and the sidewalls is avoided by virtue of the fact that all the step sections have different arcs when viewed in the plan view but have constant arcs in each of these zones. The arcs in these zones are selected or calculated such that, in every position in these zones, the rotational speed of the inner and outer drive chains is the same. The arc corresponding to the zone which links the stair landing with the central zone is such that the overall angle covered over this zone is the same for the inner and the outer drive chain. Within this region, small angular discrepancies can occur between the drive chains, the gaps of between 1 and 6 mm thus produced being compensated for by bending of the step skirts.

6 Claims, 4 Drawing Sheets

CURVED ESCALATOR

BACKGROUND OF THE INVENTION

The invention relates to a curved escalator consisting of a stair section, which is curved when viewed in plan and which is provided with a central region with a predetermined constant angle of inclination, upper and lower stair landing regions essentially with an angle of inclination that is zero as well as transition regions which connect the central region with the upper and lower stair landing regions and which are provided with changing angles of inclination for a smooth connection of these regions, wherein in the lower and upper stair landing region a plurality of horizontally disposed steps may be provided, guide curves, which ensure that the step tread in the regions is oriented horizontally, and drive chains that are fixedly linked to the steps and that are provided with a constant length between the steps, consisting of a plurality of chain links for driving the steps on an outer and inner arc, wherein the arc of the stair section when viewed in plan has a constant radius and the angular velocities of the inner drive chain and of the outer drive chain in this region are the same at any given time, the arc of the upper and lower stair landing regions when viewed in plan has a constant radius which is made larger compared to R, and the angular velocities of the inner drive chain and of the outer drive chain are the same everywhere in this region as well.

A curved escalator of the type mentioned in the beginning is known from DE-A 34 37 369. With this escalator it is not possible to describe a pure circular arc in all regions, especially in the transition regions. Furthermore, this escalator has gaps between the steps themselves and between the steps and the side walls.

From U.S. Pat. No. 4,949,832 a curved escalator is known in which the drive chain for driving the steps is provided with an additional joint between adjacent steps which is guided over cams on respective cam paths located inside and outside. In the landing zone, step paths and cam paths are located perpendicularly on top of each other, which leads to kinking the drive chains in the landing zone and in the transition zone. This is to accomplish that the horizontal component of the angular velocity of the steps remains constant and that an acceleration of the chains only takes place in vertical direction. The straightening of the drive chains in vertical direction exerts considerable pressure forces on the pivot joints so that a very complex bearing arrangement and guidance of the cam paths is required. Owing to the increased load, wear of the greatly used bearings and guide paths must also be expected.

A straightening of the drive chain is also illustrated in EP-A 390 630 in different variations, wherein, for the reinforcement of the intermediate joints a cam support plate is configured such that it can absorb horizontal as well as vertical forces. Together, the laterally mounted cam support plate, the cams and the protruding axles result in a widening of the drive chain. In the stair platform zones or in the landing zones, this leads to an increased space requirement and a complicated chain guidance, particularly in the region of the drive wheels.

From DE-B 40 36 667 a curved escalator is known in which the respective drive chain is guided on a rail that is separate from the step rail and in which different paths of travel for step and drive chain are made possible by means of a tie rod connecting the drive chain with the step. This accomplishes a precise orientation of the step axle. But at least two guide rails more are required for the guidance of the drive chain provided with the tie rod than for conventional escalators. Moreover, the steps are not held totally secure by the tie rod so that an upward movement, e.g., in case of vibration, can only be avoided by means of additional guide rails.

For the construction of curved escalators it is necessary to precisely determine the course of three-dimensional curves such as, e.g., of guide rails, drive chains and handrails. Even small deviations of 0.0010 mm result in considerable mechanical loads which result in greater wear and increased noise development during the operation of the escalator.

Moreover, the gap enlargements that occur are also not desired. Pursuant to the safety regulations in force the gaps may not exceed a value of 6 mm.

The mechanical implementation of three-dimensional curves in the configuration of a widened circular arc has proven to be particularly difficult. Since their shape is based on empirically gained solutions of approximation, individual component groups cannot be precisely calculated and manufactured. For this purpose, complicated reference planes and systems of coordinates must first be created, which make the construction of such escalators complex, expensive and time-consuming.

SUMMARY OF THE INVENTION

It is the object of the present invention to avoid the disadvantages described and to develop a curved escalator which makes possible a precise positioning of the three-dimensional curves in the design of a curved escalator and a simplified mechanical flow of movement in the transition zones.

This object is achieved by the fact that the arc of the upper and lower transition regions when viewed in plan is provided with a constant radius which is between R and Rg and that the angular velocities of the inner drive chain and of the outer drive chain in this region are the same overall, with the shape of the skirts of the steps compensating for the temporary angular displacements of the drive chains occurring in the transition regions.

The invention avoids the occurrence of inadmissibly wide gaps by, when viewed in plan, selecting arcs that are different in the three stair sections (stair landing region, transition region, central region) but constant within the regions. In the central and upper region as well as in the lower region the arcs are calculated so that at every position in these regions the angular velocities of the drive chains are the same on the inside and on the outside.

The arc of the transition region connecting the stair landing region with the central region is selected so that the angle traversed by the inner and outer drive chain is the same overall throughout this region. Within this section, minor angular displacements may occur between the drive chains but, even in a very unfavorable constellation, such as in curved escalators with a large ascending gradient and a small radius of curvature, 0.5° are not exceeded in the central region. The gaps thus produced are between 1 mm and 6 mm and may be compensated for by arching the step skirts. Thus, in all dimensions of the escalator, particularly in the transition regions, a simple mechanical curved course of the rails and guides is achieved.

For the spatial positioning of the arcs, the radii R (radius of the central stair region), Rg (radius of the upper as well as of the lower stair region), Rue (radius of the upper as well as of the lower transition region), and RueV (vertical radius of the lower as well as of the upper transition region) are set and then the associated centers are determined.

In the upper as well as in the lower transition regions, the outer drive chain connects, in the vertical, the central region with the upper as well as with the lower stair landing regions, preferably via a circle or circular arc. Alternatively, parabolas or involutes may also be provided.

According to a further idea of the invention, the handrails that are also guided like a spiral are configured to correspond to the shape of the arcs.

BRIEF DESCRIPTION OF THE DRAWINGS

The invention is illustrated by way of an embodiment and is described as follows. The figures show.

DETAILED DESCRIPTION OF THE PREFERRED EMBODIMENT

Figure 1:
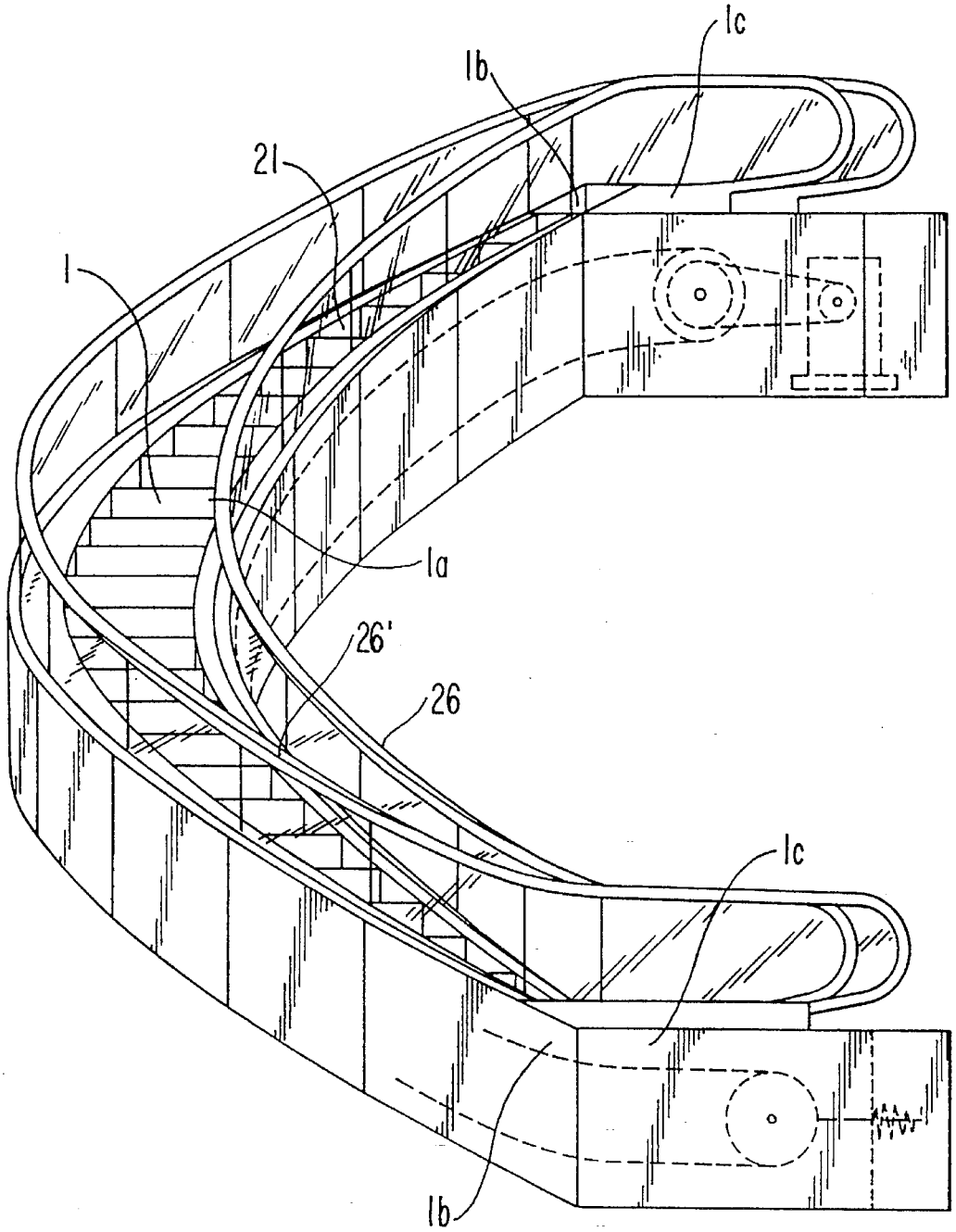
FIG. 1—stair section with handrails and steps

FIG. 1 shows a curved escalator consisting of a stair region 1 which is arcuated when viewed in plan. The stair region 1 incorporates a central region 1*a*, upper and lower stair landing regions 1*c* as well as transition regions 1*b* which connect the central region 1*a* with the stair landing regions 1*c*. In stair region 1, a plurality of sector-shaped steps 21 are provided whose course is essentially horizontal in the stair landing regions 1*c*. Analogous to the curvature of stair region 1, the handrail guides 26, 26' are also configured in an arcuated fashion when viewed in plan.

Figure 2:
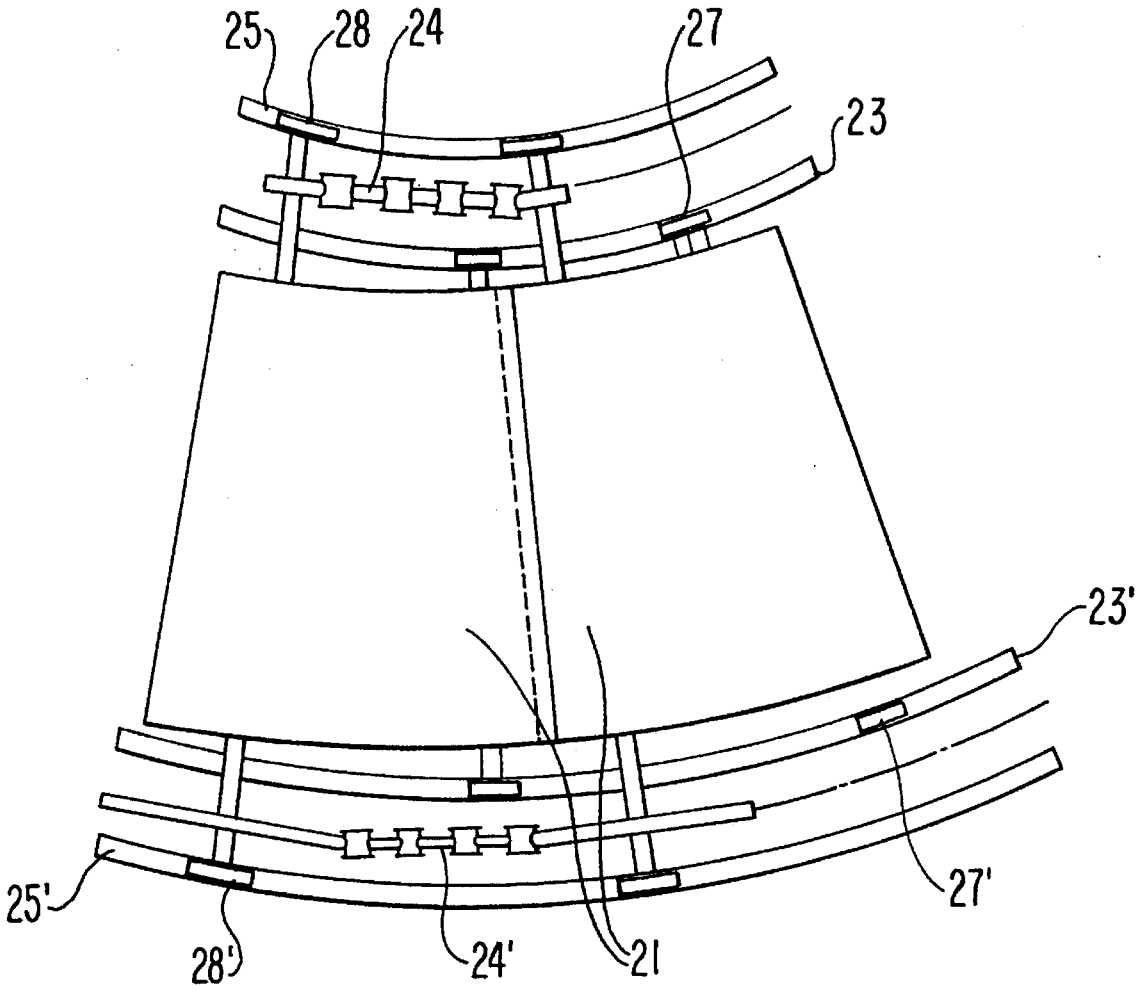
FIG. 2—plan view of two steps with the associated arcs including drive chains FIGS. 3 and 3*a*—schematic illustration of the arcs and of the associated radii FIG. 4—illustration of the arching of the step skirt.

FIG. 2 illustrates a plan view of two sector-shaped steps 21 with the associated inner and outer guide rails 23, 23' as well as the inner and outer rails 25, 25' of the drive chains 24, 24' and the drive chains 24, 24' that are affixed to the steps 21. The rollers 27, 27' are operatively connected with the guide rails 23, 23' and the rollers 28, 28' are operatively connected with the guide rails 25, 25'.

Figure 3:
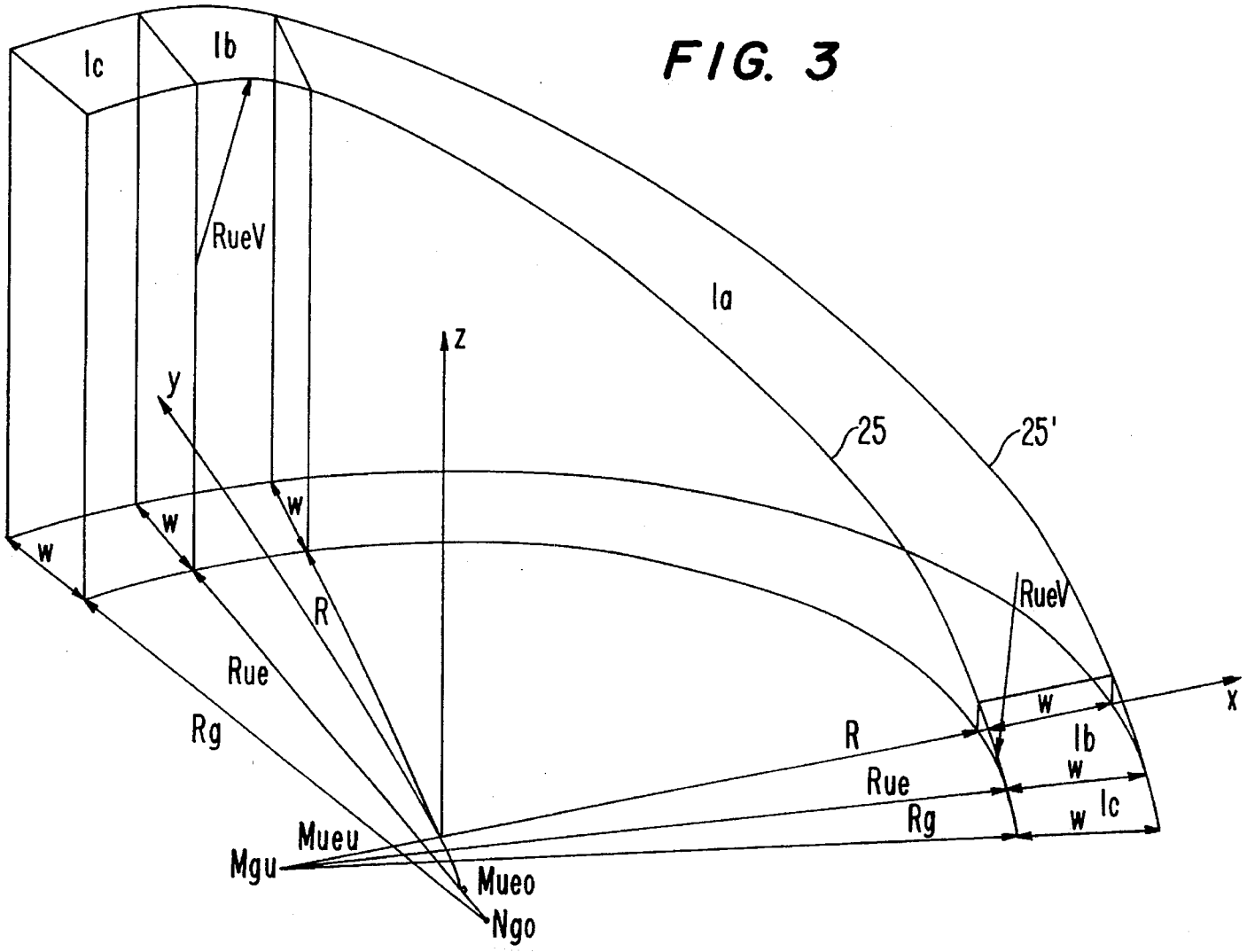
Figure 3A:
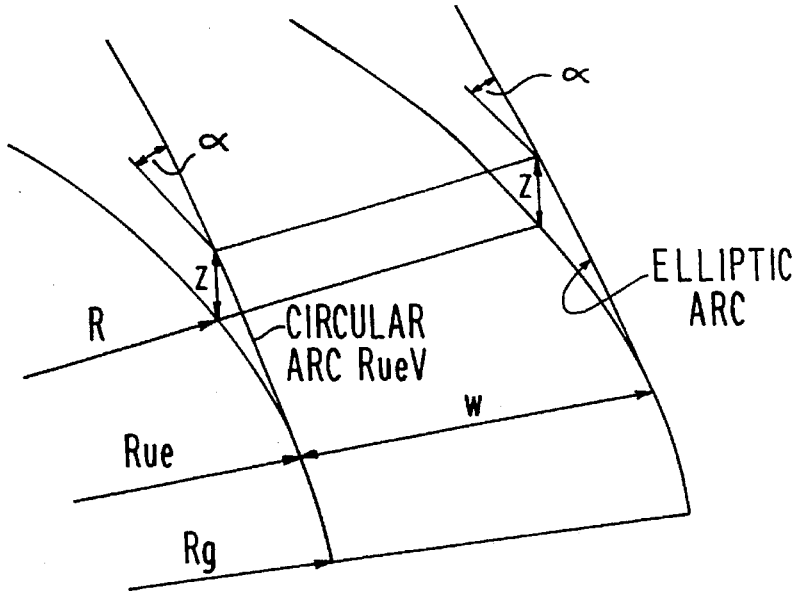

FIGS. 3 and 3*a* show a schematic illustration of the arcs 25, 25' and the associated radii R, Rg, Rue as well as RueV. Here, Mgo and Mgu represent the centers of the radii of the stair landing regions 1*c*, while Mueo and Mueu are the centers of the radii of the transition regions 1*b*. The circular arcs in the central region 1*a* as well as in the stair landing regions 1*c* are calculated so that at every position in these regions the angular velocities of the drive chains, which are not shown here in detail, are the same on the inside and on the outside. The circular arc of the transition regions 1*b* is selected so that the angle traversed by the inner and outer drive chain is the same overall throughout this region. For the spatial positioning of the arcs 25, 25', the radii R, Rg, Rue as well as RueV are set and afterwards the associated centers Mgo, Mgu, Mueo as well as Mueu are determined.

The circular arc Rue to be determined in the transition region is calculated on the basis of the following consideration:

If the radii R and Rg of the stair regions 1*a* and 1*c* are calculated pursuant to the equation:

$$Rg = \frac{R * w}{\cos(alpha)/\cos(alpha2) * (R + w) - R} \tag{1}$$

so that, in these regions, the angular velocities of the drive chains 24, 24' are always the same, then the ratio of the paths si/sa of the inner drive chain 24 and the outer drive chain 24' always is $$\frac{si}{sa} = \frac{Rg}{Rg + w}. \tag{2}$$

If a transition circle with the radius RueV is selected in the transition regions 1*b* for the inner drive chain 24 in the vertical, then the inner chain 24 traverses the path $$si = alpha * RueV \tag{3}$$

in this region.

In the vertical, the outer drive chain 24' then runs on an ellipse with the axes $$a = RueV * \frac{Rue + w}{Rue} \tag{4}$$

$$b = RueV$$

and the function equation:

$$\frac{x^2}{a^2} + \frac{z^2}{b^2} = 1. \tag{5}$$

The path on the ellipse BERueV must then be determined in the transition region 1*b* pursuant to the following equation:

$$\frac{si}{sa} = \frac{alpha * RueV}{BERueV} \tag{6}$$

or $$BERueV = alpha * RueV * \frac{Rg + w}{Rg}. \tag{7}$$

The arc length of this ellipse can then be determined pursuant to the arc integral:

$$\text{arc} = \int_{xo}^{x1} \sqrt{1 + \left(\frac{dx}{dz}\right)^2}\, dx \tag{8}$$

with the limits $$xo = 0$$

$$x1 = \sin(alpha) * RueV * \frac{Rue + w}{Rue}$$

wherein sin(alpha) * RueV indicates in the plan view the length of the arc of the inner drive chain 24 in the transition region 1*b*.

When viewed in plan, x1 then is the length of the arc of the outer drive chain 24' in the transition region 1*b*. If the function from equation (4) and (5) with the limits x0 and x1 is put into equation (8), one obtains $$BERueV = \int_0^{\sin(alpha) * RueV * \frac{Rue + w}{Rue}} \sqrt{1 + \left(\frac{x * \frac{Rue^2}{(Rue + w)^2}}{RueV^2 - x^2 * \frac{Rue^2}{(Rue + w)^2}}\right)^2}\, dx \tag{9}$$

with Rue as an unknown quantity.

With the aid of the procedure according to Simpson or another algorithm for the numerical determination of a certain integral, the radius Rue can now be calculated with any desired precision.

In the following, the excerpt of a procedure with a purchasable Pascal program is rendered, according to which Rue can be found with the help of the Simpson procedure and with a radius Rue starting from a base value R.

(1) RueV is the vertical elliptic radius (2) R is the radius of the inner circular arc (3) VDiff is the differential between the elliptic arc illustrated towards the inside and the inner circular arc RueV (4) RueV is set=R and calculations are performed with different values of R until VDiff is below the preset tolerance limit (5) the increment size with which the values of R are changed is, e.g., 10

(6) the increment size is made smaller until the desired precision of RueV is reached.

The table that follows indicates the dimensions in mm for a typical curved escalator:

R=4200, Rg=5454.7, Rue=5024.5, w=1014, alpha=30°. The correction of the arching of the step skirt (FIG. 4, correction of the skirt) in this example should be proportional to the deviation of the step axle or of the chains to the desired orientation towards the center of the circle of the transition circles. This deviation only occurs in the transition regions 1*b*. As can be seen from the table, the deviation first has the value of zero in the beginning of the transition zone and it then increases in the course of the transition zone to 4.41 mm maximum or 0.237°. In the ascending zone the value of zero is then reached again so that the conditions are as follows.

| Deviation of axles in degrees | Deviation of axles in mm |
|---|---|
| 0.00° | 0.00 mm transition zone |
| 0.03° | 0.57 mm |
| 0.06° | 1.13 mm |
| 0.09° | 1.68 mm |
| 0.11° | 2.19 mm |
| 0.14° | 2.67 mm |
| 0.16° | 3.11 mm |
| 0.18° | 3.50 mm |
| 0.20° | 3.82 mm |
| 0.21° | 4.08 mm |
| 0.22° | 4.27 mm |
| 0.23° | 4.38 mm |
| 0.237° | 4.41 mm |
| 0.23° | 4.35 mm |
| 0.22° | 4.20 mm |
| 0.21° | 3.95 mm |
| 0.19° | 3.61 mm |
| 0.16° | 3.16 mm |
| 0.14° | 2.61 mm |
| 0.10° | 1.96 mm |
| 0.06° | 1.21 mm |
| 0.03° | 0.06 mm |
| 0.00 | 0.00 mm ascending zone |

Figure 4:
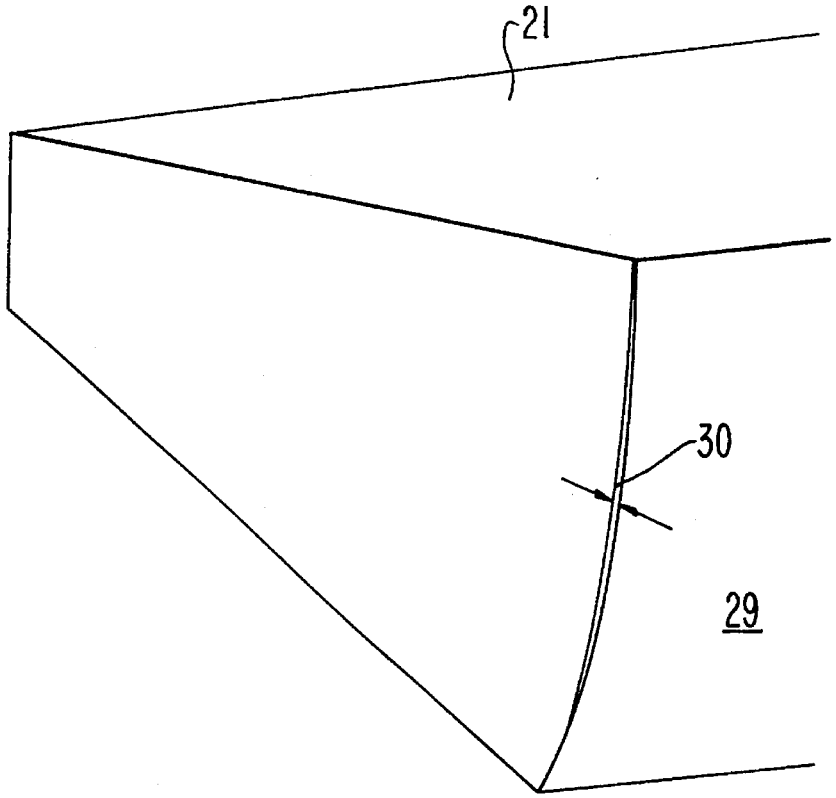

FIG. 4 shows a step 21 in three-dimensional illustration which, in the moving direction, is provided with a skirt 29 having an arched configuration. Particularly in curved escalators with a large ascending gradient and a small radius of curvature, gaps are created between the individual steps 21 as well as between steps and side walls, which may possibly be outside of the tolerances of safety regulations in force. In order to deal with this problem further arched regions 30 are provided which return the gaps to be within justifiable limits.

I claim:

1. Curved escalator consisting of a stair section (1), which is curved when viewed in plan and which is provided with a central region (1*a*) with a predetermined constant angle of inclination, upper and lower stair landing regions (1*c*) essentially with an angle of inclination that is zero as well as transition regions (1*b*) which connect the central region (1*a*) with the upper and lower stair landing regions (1*c*) and which are provided with changing angles of inclination for a smooth connection of these regions, wherein in the lower and upper stair landing region (1*c*) a plurality of horizontally arranged steps (21) may be provided, guide curves (23, 23'), which ensure that the step treads in the regions (1*a*, 1*b*, 1*c*) are oriented horizontally, and inner and outer drive chains (24, 24') that are fixedly linked to the steps (21) and that are provided with a constant length between the steps, consisting of a plurality of chain links for driving the steps on an outer and inner arc (25, 25'), wherein the arc of the central region (1*a*) when viewed in plan has a constant radius R and the angular velocities of the inner drive chain (24) and of the outer drive chain (24') while in the central region are the same at any given time, the arc of the upper and lower stair landing regions (1*c*) when viewed in plan has a constant radius Rg which is made larger compared to R, and the angular velocities of the inner drive chain (24) and of the outer drive chain (24') are the same everywhere in the upper and lower stair landing regions as well, characterized in that the arc in each of the upper and lower transition regions (1*b*) when viewed in plan is provided with a constant radius (Rue) which is between R and Rg and that the angular velocities of the inner drive chain (24) and of the outer drive chain (24') in each of these respective upper and lower transition regions are the same overall, said steps (21) having skirts which are shaped to compensate for the temporary angular displacements of the drive chains (24, 24') occurring in the transition regions (1*b*).

2. Curved escalator according to claim 1, characterized in that the radius (Rg) of the arcs of the upper and lower stair landing regions (1*c*) is determined through the following equation:

$$Rg = \frac{R * w}{\cos(alpha)/\cos(alpha2) * (R + w) - R}$$

for alpha2 the following applies:

$$alpha2 = \arctan \frac{R * \tan(alpha)}{R + w}$$

wherein

R=radius of curvature of the central region (1*a*) of the stair section (1), alpha=angle of inclination of the inner drive chain (24) in the central region (1*a*) of the stair section (1), w=distance between the inner drive chain (24) and the outer drive chain (24').

3. Curved escalator according to claim 1 in whose upper and lower transition regions (1*b*), in the vertical, the inner drive chain (24) connects the central region (1*a*) with the upper and lower stair landing regions (1*c*) via a circle (RueV) whose shape corresponds to the following function equation:

$$x^2+z^2=RueV^2$$

while, in this region, the path of the outer drive chain (24'), in the vertical, is an ellipse whose horizontal axis (a) and whose vertical axis (b) are determined by the following equations:

$$a = RueV * \frac{Rue + w}{Rue}$$

$$b = RueV$$

and that the arc length of the ellipse (BERueV) in the transition regions (1*b*) corresponds to the following equation:

$$BERueV = alpha * RueV * \frac{Rg + w}{Rg}$$

characterized in that the radius of the transition regions (Rue) can be determined from the following equation:

$$BERueV = \int_0^{\sin(alpha) * RueV * \frac{Rue + w}{Rue}} \sqrt{1 + \left( \frac{x * \frac{Rue^2}{(Rue + w)^2}}{RueV^2 - x^2 * \frac{Rue^2}{(Rue + w)^2}} \right)^2} \, dx$$

4. Curved escalator according to one of claim 1, characterized in that in its upper and lower transition regions (1*b*) the outer drive chain (24') in the vertical connects the central region (1*a*) with the upper and lower stair landing regions (1*c*) via a circle (RueV).

5. Curved escalator according to claim 1, characterized in that in the upper and lower transition regions (1*b*) the inner or outer drive chain (24, 24') in the vertical connects the central region (1*a*) with the upper and lower stair landing regions (1*c*) via a parabola or an involute.

6. Curved escalator according to one of claim 1, characterized in that in the regions (1*a*, 1*b* and 1*c*) an inner and an outer handrail guide is provided (26, 26') which, when viewed in plan, is provided with arcs that correspond to those of the associated drive chain (24, 24').

* * * * *